US008596288B2

(12) United States Patent
Daily

(10) Patent No.: US 8,596,288 B2
(45) **Date of Patent: *Dec. 3, 2013**

(54) CRUTCH ASSEMBLY

(75) Inventor: Jesse Daily, West Bend, WI (US)

(73) Assignee: Core Consulting, LLC, Whitefish Bay, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/456,372

(22) Filed: Apr. 26, 2012

(65) Prior Publication Data

US 2012/0227777 A1 Sep. 13, 2012

Related U.S. Application Data

(63) Continuation of application No. 12/667,353, filed as application No. PCT/US2008/068946 on Jul. 2, 2008, now Pat. No. 8,166,990.

(60) Provisional application No. 60/947,582, filed on Jul. 2, 2007.

(51) Int. Cl.
*A61H 3/02* (2006.01)
*A45B 9/04* (2006.01)

(52) U.S. Cl.
USPC ..... 135/82; 135/65; 135/84; 248/188.9

(58) Field of Classification Search
USPC ..... 135/65–66, 68, 77, 84, 82; 248/188.1–188.3, 188.9, 615–616, 248/624; 280/819; 16/42 R, 42 T, 43
See application file for complete search history.

(56) References Cited

U.S. PATENT DOCUMENTS

| | | | | |
|---|---|---|---|---|
| 332,684 | A | | 12/1885 | Tuttle |
| 765,984 | A | | 7/1904 | Morris et al. |
| 1,061,397 | A | | 5/1913 | Newell |
| 1,348,531 | A | | 8/1920 | Amadio |
| 2,449,509 | A | * | 9/1948 | Richards ..... 135/80 |
| 2,453,742 | A | | 11/1948 | Bowen et al. |
| 2,528,706 | A | | 11/1950 | Osborn |
| 2,670,748 | A | | 3/1954 | Greene et al. |
| 2,753,586 | A | | 7/1956 | Metz |
| 2,888,022 | A | | 5/1959 | Fanning |
| 2,910,995 | A | | 11/1959 | Jacuzzi |
| 3,335,735 | A | | 8/1967 | Colegrove et al. |
| 3,901,258 | A | | 8/1975 | Montgomery |
| 4,098,283 | A | | 7/1978 | Tritle, Jr. |
| 4,411,284 | A | | 10/1983 | Opitz |
| 4,440,186 | A | | 4/1984 | Lottner |
| 4,510,957 | A | | 4/1985 | Frank |

(Continued)

FOREIGN PATENT DOCUMENTS

JP 2009183436 A * 8/2009

OTHER PUBLICATIONS

Notification of Transmittal of the International Search Report and the Written Opinion of the International Searching Authority, or the Declaration; Jan. 15, 2009; 11 pages.

*Primary Examiner* — Winnie Yip
(74) *Attorney, Agent, or Firm* — Whyte Hirschboeck Dudek S.C.

(57) ABSTRACT

An improved crutch assembly and walking aid is provided. The crutch assembly can be retrofitted to an existing walking aid and provides spring assisted motion. The assembly includes a ball-in-socket joint and a spring operably connecting the joint to a walking aid shaft.

20 Claims, 4 Drawing Sheets

(56) References Cited

U.S. PATENT DOCUMENTS

| | | | | |
|---|---|---|---|---|
| 4,708,154 | A | 11/1987 | Edwards | |
| 4,947,882 | A | 8/1990 | Levasseur | |
| 4,977,914 | A | 12/1990 | Smerker | |
| 5,331,990 | A | 7/1994 | Hall et al. | |
| 5,775,352 | A | 7/1998 | Obitts | |
| 5,860,228 | A | 1/1999 | Bathum | |
| 5,924,434 | A | 7/1999 | Cato, III | |
| 6,216,713 | B1 | 4/2001 | Kennan | |
| 6,286,529 | B1 | 9/2001 | Olivera | |
| 6,374,841 | B1 | 4/2002 | Yamamoto et al. | |
| 6,883,530 | B2 | 4/2005 | Kawakami | |
| 7,503,337 | B1 * | 3/2009 | Morgan et al. | 135/70 |
| 7,588,044 | B2 | 9/2009 | Baker | |
| 7,871,337 | B2 * | 1/2011 | Moore | 473/296 |
| 8,166,990 | B2 | 5/2012 | Daily | |

* cited by examiner

CRUTCH ASSEMBLY

CROSS REFERENCE TO RELATED APPLICATIONS

The present application claims priority to U.S. patent application Ser. No. 12/667,353, filed on Dec. 30, 2009, which is a national stage entry of PCT/US2008/068946, filed on Jul. 2, 2008, which claims priority to U.S. Provisional Application No. 60/947,582, filed on Jul. 2, 2007, and each of these applications are hereby incorporated by reference in their entireties herein.

FIELD OF THE INVENTION

Embodiments of the present invention generally relate to mobility and walking aids. More specifically, various embodiments of the present invention relate to accessories for mobility and walking aids.

BACKGROUND OF THE INVENTION

Reduced or inhibited mobility presents a significant problem for many people. Whether it is an injury to the leg, hip, or the result of increased age, mechanical devices are often used for assisting the user to enhance their mobility. Canes, crutches, walking sticks and various other devices have been in use for a considerable time. However, the functional design of these devices has remained substantially the same. Unfortunately for the user, these devices are often cumbersome, uncomfortable, and difficult to use in slippery surface situations.

It would be advantageous for a crutch, or similarly constructed walking aid, to provide greater comfort for the user. It would be further advantageous for the walking aid to utilize the user's energy in mechanically assisting the user while walking. Furthermore, it would be advantageous for a walking aid to provide enhanced grip on slippery and/or uneven surfaces.

SUMMARY OF THE INVENTION

In accordance with at least one embodiment of the invention, an assembly comprising ball and socket joint having a substantially spherical ball section and a socket section is provided. The ball section is operably connected to a coiled spring and the socket section is integrally formed with a mount. A gripping sole is integrally formed with the mount opposite the ball section and the gripping sole has a gripping surface. The spring housing is operably connected to the coiled spring opposite the ball section, the spring housing having an attachment means for releasable attachment to a walking aid shaft, and the ball and socket joint moves freely with respect to the coiled spring.

In accordance with at least one embodiment of the invention, a method for assembling a walking aid having a spring mechanism is provided. The method includes sliding an assembly gauge over a walking aid shaft, pushing a connecting pin device inside the shaft, guiding a connecting pin device with an assembly gauge, sliding a spring housing up the shaft distal to a surface end, sliding a spring on the shaft and away from the surface end, connecting a head mechanism with the shaft proximal to the surface end, and pushing a head into a housing recess.

In accordance with yet another embodiment of the present invention, a walking aid is provided with a shaft releasably connected to a ball and socket joint having a ball section and socket section. The ball section is operably connected to a coiled spring. The walking aid includes a gripping sole integrally formed with the joint, wherein the ball and socket joint moves freely with respect to the coiled spring.

In accordance with at least one embodiment of the invention a spring assisted walking aid is provided with a shaft operably connected to a ball and socket joint in part through a compressible spring attached directly to a ball section of the joint. The ball section moves freely with respect to a socket section. The walking aid includes a releasably attached gripping sole.

DETAILED DESCRIPTION OF THE PREFERRED EMBODIMENT

Figure 1C:
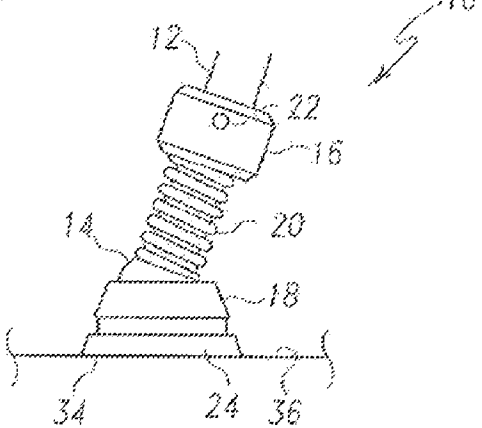
FIGS. 1*a-c* provide a perspective view of the crutch assembly during three separate positions of a walking sequence in accordance with at least one embodiment of the present invention.
Figure 1B:
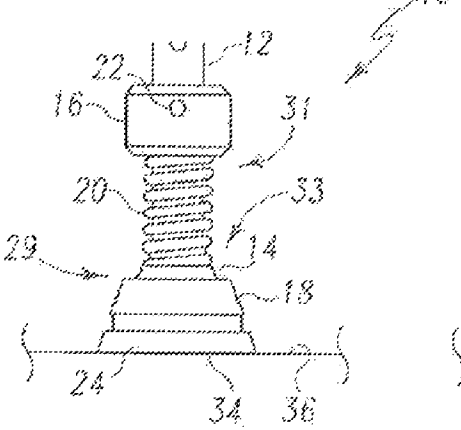
Figure 1A:
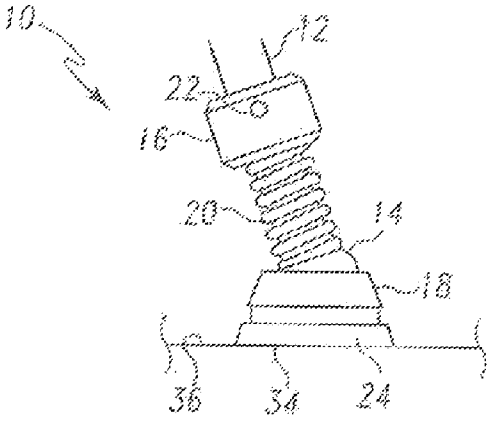
Figure 2:
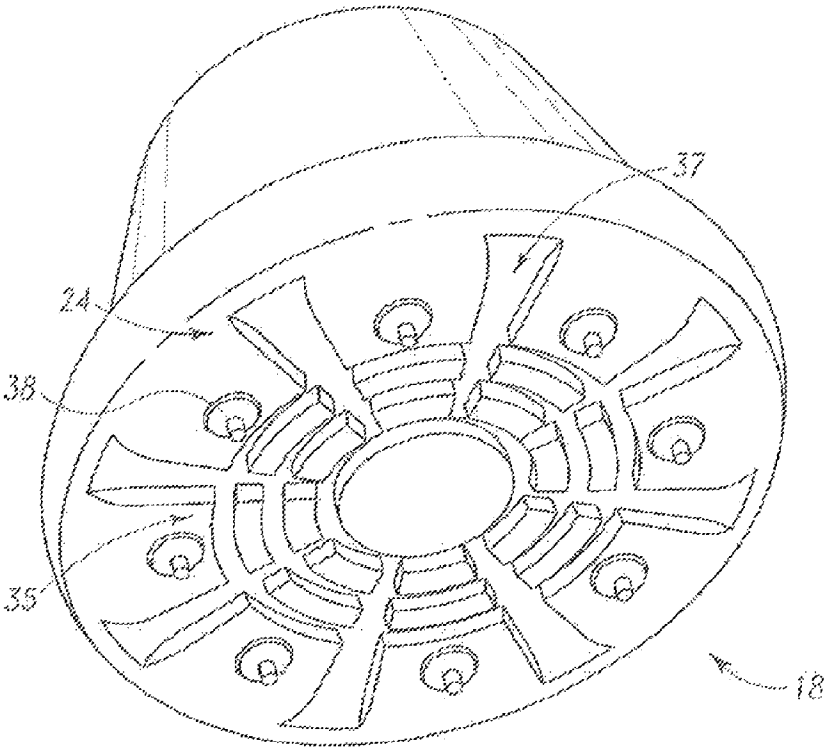
FIG. 2 is a perspective view of the socket housing and grip of the crutch assembly in accordance with at least one embodiment of the present invention.

Referring to FIGS. 1-2, a walking aid assembly 10 is provided in three positions (FIGS. 1*a-c*). The assembly 10 is attached to a walking aid shaft 12. The assembly 10 includes a ball-in-socket head 14, a spring housing 16, a socket housing 18, a spring 20, compression pins 22, grip 24, and assembly gauge 26 (See FIG. 3). The head 14 is positioned within the housing 18, such that the interior surface 28 (See FIG. 4) of the housing 18 is substantially the same shape as the head 14, thereby forming a ball-in-socket joint 29. The interior surface 28 is slightly larger than the head 14 to allow for rotational movement of the head 14 with respect to the housing 18.

The spring housing 16 is attached to the shaft 12 by pins 22. The quick release buttons 22 extend outward from the shaft 12, and penetrate through the shaft apertures 30 and gauge apertures 32. The spring housing 16 and assembly gauge 26 are slidably engaged with the shaft 12. The assembly 10 is easily attached to and removed from the shaft 12 of a crutch (not shown), or alternative walking aid, by depressing the pins 22 on at least one side of the housing 18 and then sliding the housing 16 on or off the shaft 12.

The spring 20 is fixedly attached to the spring housing 16 on a first end 31 and the head 14 on a second end 33. The compression coiled spring 20 can alternatively be a helical spring. The spring 20 can alternatively be loosely fitted between the housing 16 and head 14 or fixedly attached to either end separately. The spring 20 configuration is designed to avoid contact with the housing 18, thereby allowing free range of motion for the joint 29. By limiting contact with the spring to the ball section at end 33, the gripping section 34 more easily and effectively comes in contact with a surface 36 while the assembly 10 is in use. By attaching the spring to the head 14 rather than the housing 18, the user has greater range of motion for movement and mobility over more uneven surfaces 36 and terrain. Placement of the spring 20 avoids inhibiting the rotational movement of the joint 29. In the present embodiment, placement of the spring can restrict excess rotation of the joint (See 1*a* and 1*c*). In an alternative embodiment, the spring is attached to the ball section 14 such that the spring 20 never comes in contact with the housing 18. In alternative embodiment, various spring-like mechanisms can be used, by example, high density compression foam or gas operated shock absorbing device. In yet another alternative embodiment, a conical compression spring (not shown) can be used, which is preferred when the cross sectional area of the head 14 is either larger or smaller than that of the housing 16.

The grip 24 is attached to the socket housing 18. Although it is contemplated that various shapes can be formed by the grip 24, the present embodiment has a substantially circular and flattened disc-shape and has a diameter of approximately 2 inches. Alternatively, the diameter of the grip 24 can range from about 0.5 inches to about 5.0 inches. In an alternative embodiment, the diameter of the grip 24 is either less than about 0.5 inches or greater than about 5.0 inches. The grip 24 has a thickness in a range of about 0.2 inches to about 0.8 inches. In an alternative embodiment the grip 24 has a thickness either less than about 0.2 inches or greater than about 0.8 inches. At a point where the housing 18 and grip 24 are joined, the housing 18 forms a substantially circular shape. In an alternative embodiment, the grip 24 is releasably engaged with the mount 18. The releasable engagement (not shown) can be a frictional snap-fit, threaded screw arrangement or a twist and snap locking mechanism, or an alternative engagement means readily available to one skilled in the art. The user can replace the grip after it has worn out, or the user can replace the grip 24 based upon the desired use and surface conditions. Walking over icy, snowy or generally slippery conditions are best suited for the cleated grip 24 embodiment (See FIG. 2), which is also preferred for uneven and loose surfaces.

Grip surface 34 has a gripping tread 35, which includes a plurality of channels 37 similar to that of motor vehicle tire treads. The present embodiment includes a plurality of channels 37 radiating outward from the center of the circle formed by the surface 34, as well as a plurality of channels 37 forming concentric circles of varying diameter. The surface area of the surface 34 is increased by the formation of tread 35, and furthermore acts to reduce slippage and hydroplaning effects between the assembly 10 and the surface 36.

The mount 18, housing 16 and joint 14 are made of a hard impact resistant material, such as delryn and/or ABS plastic or other suitable material. The grip 24 is made of a slip-resistance material, such as high coefficient of friction or low durometer urethane, or various synthetics, plastics, or other suitable slip-resistant material known by one skilled in the art.

As the user reaches forward with the crutch assembly 10 the grip surface 34 engages the walking surface 36 (See FIG. 1*a*). The spring 20 compresses as a user begins forward motion, which is generally indicated by the direction of FIG. 1*a* to FIG. 1*c*. The compressed spring stores energy created by the user during a walking sequence. At the same time the ball 14 and socket 18 assembly provides a guide for the desired direction of travel. The spring 20 is compressed to approximately ¾ the uncompressed length when the user is about halfway through the walking sequence (See FIG. 1*b*). Spring 20 compression provides a vibrational dampening effect such that the user is subjected to a lower level of vibrations and perturbations transferred from the surface 34 through the shaft 12. As forward motion continues the compressed spring decompresses and propels the user forward (See FIG. 1*c*), thereby utilizing otherwise lost energy from the walking sequence. Alternatively, the spring 20 can be compressed in a range of about 20% to about 90% of its greatest length. The tension of the spring 20 can be altered based upon the primary use and weight of the user. In an alternative embodiment, the spring 20 is a combination of two or more separate springs. Alternatively, the user can reverse the walking sequence in order to move backwards with respect to the direction they are facing. Furthermore, the user can move from side-to-side, or in combination with, a reverse or forward movement.

Cleats 38 are attached to the grip 24 for increased traction on rough walking surfaces. The cleats 38 are adhered to the bottom surface 34 through a variety of attachment means, which includes adhesives, threaded screw attachment, integrally molded, and other means known to one skilled in the art. Alternatively, the cleats 38 can be a variety of shapes and sizes, including pyramidal-shaped, conical cleats and those similar to golf shoe cleats.

Embodiments of the present invention provide reduced vibrational impact to the user as the crutch 10 contacts the surface during the user's walking sequence. Due to the placement of the spring 20 with respect to the crutch shaft 12 joint 29, the assembly 10 provides a dampening effect regardless of the surface angle. Furthermore, the spring 20 compresses after contacting the surface. When the user moves forward the spring 20 releases, thereby adding energy to the forward walking sequence to assist the user's forward motion. By reducing the dampening effect and utilizing the stored spring energy for forward motion, there is a significant reduction in fatigue to the user. Necessarily the user is able to traverse greater distances and use the device for greater periods of time before fatigue inhibits the user.

Figure 3:
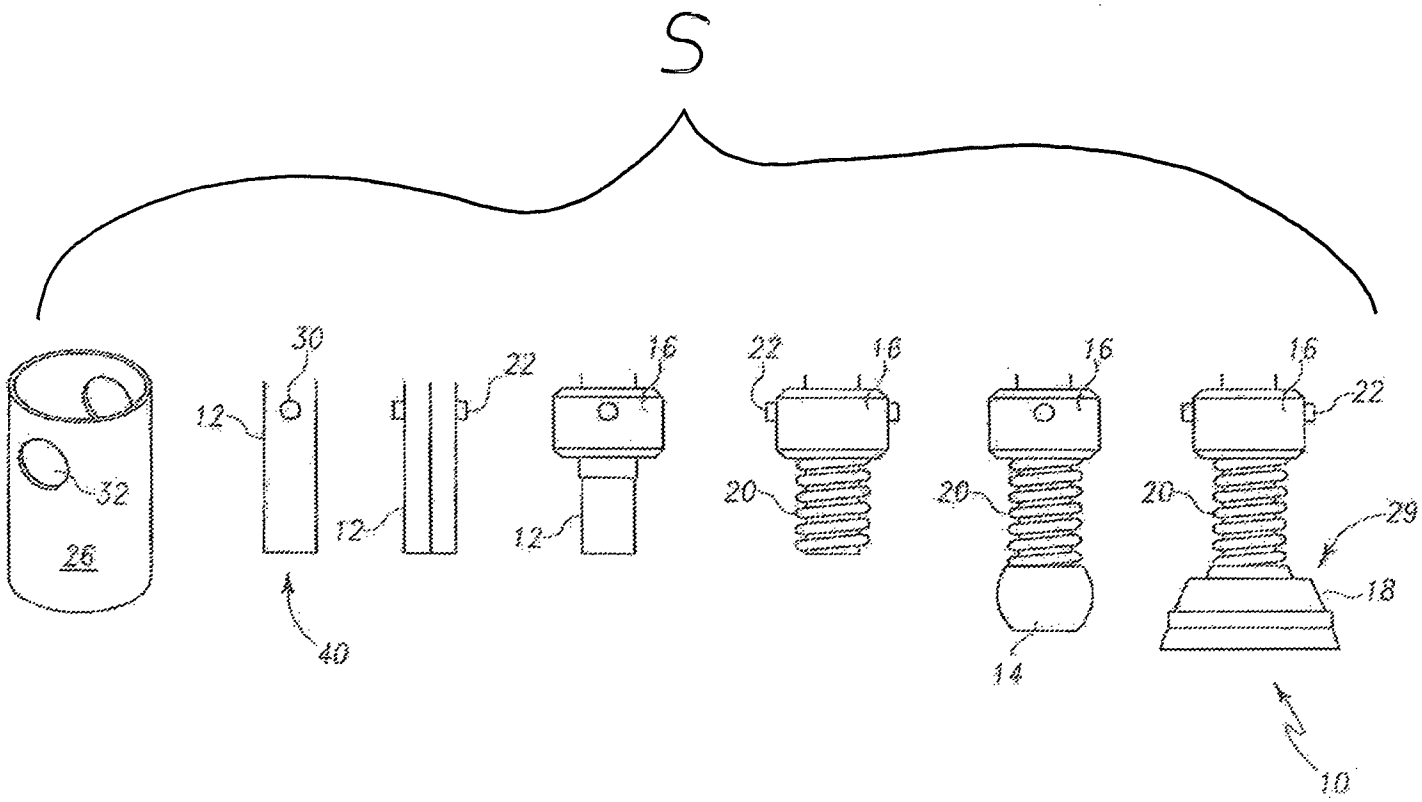
FIG. 3 is an assembly sequence view of the crutch assembly in accordance with at least one embodiment of the present invention.
Figure 4:
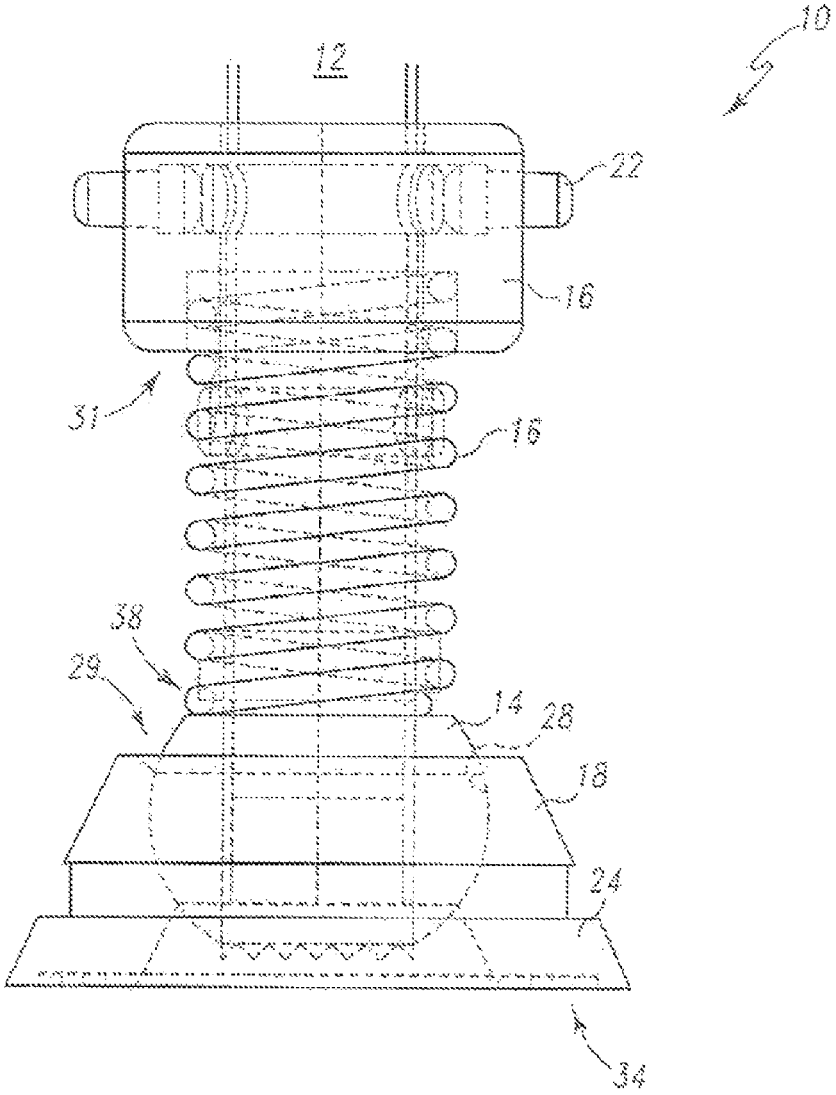
FIG. 4 is a partial cross sectional view of the crutch assembly in accordance with at least one embodiment of the present invention.

Now referring to FIG. 3, existing walking aids, such as crutches, walking sticks, and the like can be retro-fitted with little difficulty. The relatively simple, yet elegant design of the device 10 provides great ease for combining it with an existing walking aid. After removing the original walking aid tip (not shown), the user slides the gauge over the shaft 12 and uses the apertures 32 as a guide to drill a hole through the device shaft 12 proximal to the walking surface 36 end. Alternatively, the walking aid can be provided with a pre-existing aperture 30. Depending upon the device dimensions and preferred use, the aperture 30 can be in a range from about 1 inch to about 6 inches from the surface end 40. Compression pins 22 are pushed inside the shaft from the bottom of the hollow shaft 12 and protrude from the holes 30 drilled (or prefabricated) in the shaft 12. The spring housing 16 is slid up the shaft and away from the surface end 40. When the housing 16 comes in contact with the pins 22 it locks with the compression pins 22 and the holes 30. The spring 20 is slid up the shaft 12, away from the surface end 40. A bead of adhesive is applied to the area where the housing 16 and spring 20 meet. Thereafter, the head 14 is snapped into place on the shaft 12 proximal to the surface end 40 and an adhesive is applied to the head 14 and coil 22 at the point where they meet. The head 14 is pushed into the housing 18 recess and is snap-fit into the housing recess having a surface 28. The grip 24 is then attached to the housing 18. Alternatively, the grip 24 is integrally formed with the housing 18. The user can choose a variety of grip 24 types, depending upon the surface 36 conditions, and can opt for a cleated grip 24 (See FIG. 2).

Embodiments of the present invention can be used in conjunction with a variety of walking aids (not shown). Representative walking aids can be selected from the group comprising a crutch, a cane, a walking stick, and a walking frame. The crutch can be selected from the group comprising a forearm crutch, a knee crutch, an underarm crutch, and a platform crutch. It is further contemplated that alternative forms of walking aids presently know can be fitted with an embodiment of the present invention.

It is specifically intended that the present invention not be limited to the embodiments and illustrations contained herein, but include modified forms of those embodiments including portions of the embodiments and combinations of elements of different embodiments as come within the scope of the following claims.

I claim:

1. A walking aid assembly, the assembly-comprising:

a spring housing configured for releasable attachment to a walking aid shaft at a location away from an end of the shaft;

a spring mechanism configured to receive and extend around an end portion of the walking aid shaft and including a first end coupled with the spring housing and a second end opposite the first end;

a head mechanism having an at least partially spherically-shaped section connected with the second end of the spring mechanism and configured for connection proximate the end of the walking aid shaft; and a mount having a recess configured to receive therein and contact the at least partially spherically-shaped section of the head mechanism in a freely rotatable manner, such that a portion of the head mechanism extends outwardly from the mount, and such that second end of the spring mechanism is exterior of the recess.

2. The walking aid assembly of claim 1, wherein the recess is configured such that the head mechanism is positioned substantially within the mount.

3. The walking aid assembly of claim 2, wherein the spring housing is connected to the first end of the spring mechanism.

4. The walking aid assembly of claim 3, wherein the head mechanism is connected to the second end of the spring mechanism.

5. The walking aid assembly of claim 4, wherein the gripping section includes a gripping surface.

6. The walking aid assembly of claim 5, wherein the mount is configured to move in a freely rotatable manner with respect to the spring mechanism.

7. The walking aid assembly of claim 1, wherein: (i) the recess is configured such that the head mechanism is positioned substantially within the mount; (ii) the spring housing is connected to the first end of the spring mechanism; (iii) the head mechanism is connected to the second end of the spring mechanism; and (iv) the mount is configured to move in a freely rotatable manner with respect to the spring mechanism.

8. The walking aid assembly of claim 7, further comprising a gripping section configured to be operably coupled to the mount.

9. A walking aid assembly in combination with a walking aid, the combination comprising:

a walking aid having a walking aid shaft; and a walking aid assembly, the assembly comprising:

a spring housing configured for releasable attachment to the walking aid shaft at a location away from an end of the shaft;

a spring mechanism configured to receive and extend around an end portion of the walking aid shaft and including a first end coupled with the spring housing and a second end opposite the first end;

a head mechanism having an at least partially spherically-shaped section connected with the second end of the spring mechanism and configured for connection proximate the end of the walking aid shaft; and a mount having a recess configured to receive therein and contact the at least partially spherically-shaped section of the head mechanism in a freely rotatable manner, such that a portion of the head mechanism extends outwardly from the mount, and such that second end of the spring mechanism is exterior of the recess; and a gripping section configured to be operably coupled to the mount.

10. The combination of claim 9, wherein: (i) the recess is configured such that the head mechanism is positioned substantially within the mount; (ii) the spring housing is connected to the first end of the spring mechanism; (iii) the head mechanism is connected to the second end of the spring mechanism; and (iv) the mount is configured to move in a freely rotatable manner with respect to the spring mechanism.

11. The combination of claim 9, wherein the gripping section is releasably engaged with the mount.

12. The combination of claim 11, wherein gripping section includes a sole with a plurality of cleats.

13. The combination of claim 9, wherein the walking aid is one of a crutch, a cane, a walking stick, and a walking frame.

14. The combination of claim 13, wherein the crutch is one of a forearm crutch, a knee crutch, an underarm crutch, and a platform crutch.

15. The combination of claim 9, wherein the spring mechanism is a coiled spring.

16. The combination of claim 15, wherein the spring is capable of compressing to less than about ¾ a non-compressed length.

17. A method for assembling the walking aid assembly of claim 1, the method comprising:

providing the walking aid assembly of claim 1; providing a walking aid shaft; sliding the spring housing of the walking aid assembly onto the shaft to the location away from an end of the shaft;

sliding the spring mechanism onto the shaft so as to be operably associated with the spring housing;

connecting the head mechanism with the shaft proximate the end of the shaft; and receiving the at least partially spherically-shaped section of the head mechanism at least substantially into the recess of the mount.

18. The method of claim 17, further comprising applying an adhesive between the spring mechanism and the head mechanism.

19. The method of claim 17, further comprising attaching the spring housing to the walking aid shaft using a connecting pin device.

20. The method of claim 17, further comprising attaching a gripping section to the mount.

* * * * *